United States Patent [19]

Tung

[11] 4,126,315

[45] Nov. 21, 1978

[54] MATHEMATICAL BASED BOARD GAME APPARATUS

[76] Inventor: Chuen K. Tung, 177 White Plains Rd., Apt. 69F, Tarrytown, N.Y. 10591

[21] Appl. No.: 797,934

[22] Filed: May 18, 1977

[51] Int. Cl.[2] ..... A63F 3/02

[52] U.S. Cl. ..... 273/271; 273/284; 273/288

[58] Field of Search ..... 273/130 R, 135 R, 271, 273/284, 288

[56] References Cited

U.S. PATENT DOCUMENTS

| | | | |
|---|---|---|---|
| 3,610,626 | 10/1971 | Nolte | 273/131 AB |
| 4,043,559 | 8/1977 | Eigen et al. | 273/130 R |

FOREIGN PATENT DOCUMENTS

| | | | |
|---|---|---|---|
| 2,279,436 | 2/1976 | France | 273/131 B |

*Primary Examiner*—Anton O. Oechsle
*Attorney, Agent, or Firm*—Hubbell, Cohen, Stiefel & Gross

[57] ABSTRACT

A mathematical based board game apparatus employs a matrix grid game board containing a playing area defined by a plurality of grid units each capable of containing a game playing piece. In the playing area, the placement or removal of a plurality of regular game playing pieces takes place in accordance with logically defined move patterns, such as straight chains, +-shapes, X-shapes, S-shapes, etc., or various combinations thereof. During alternating designated turns the players completely cover, or uncover if the inverse of the game is played, all of the grid units defining the ultimate playing area to determine the winner of the game. A plurality of different overlays for the game board are provided, with changeable superimpositions of various overlays being utilized, if desired, to vary the size and/or configuration of the initially exposed game playing area. Blocking pieces are also provided which are deployable prior to the playing of the game to further define the exposed game playing area. In addition, connective various types of game playing pieces are also provided which are deployable prior to the playing of the game for establishing link nodes during the playing of the game to enable positional privileged placement, or removal if the inverse of the game is played, of regular game playing pieces by the players in accordance with the logically defined move patterns. The blocking pieces and/or connective pieces may be deployed prior to the playing of the game in order to vary the complexity of each game.

11 Claims, 66 Drawing Figures

FIG. 12.
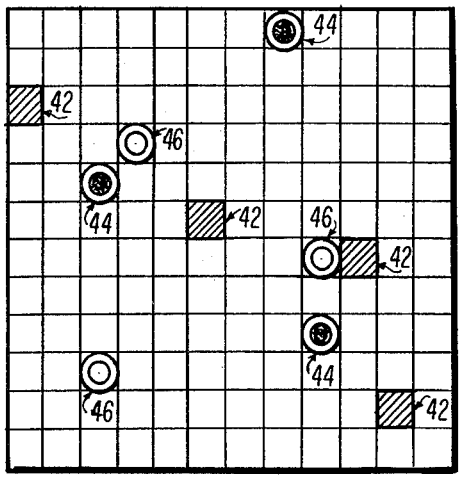
FIG. 13.
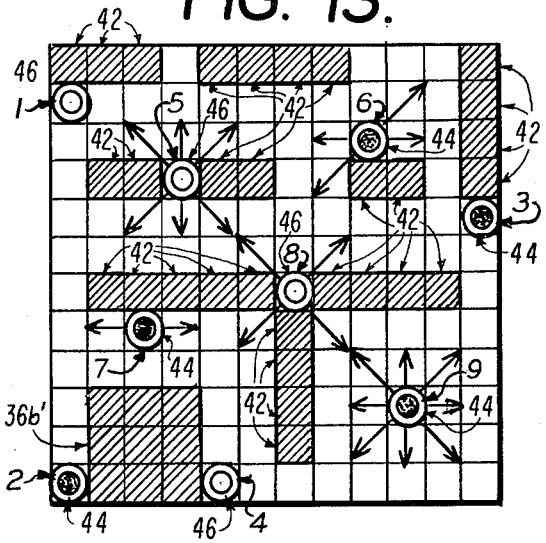
FIG. 14.
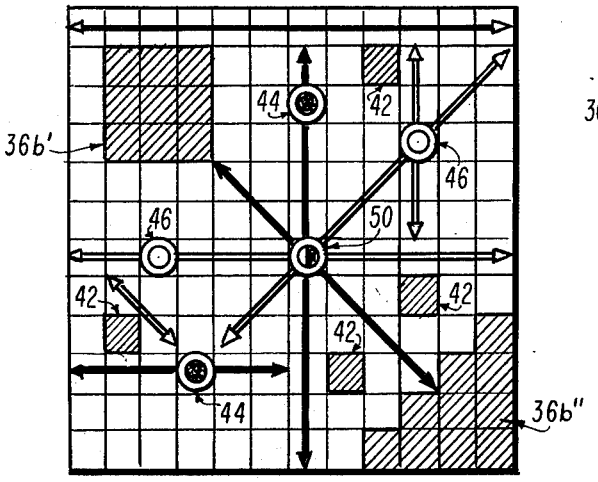
FIG. 15.
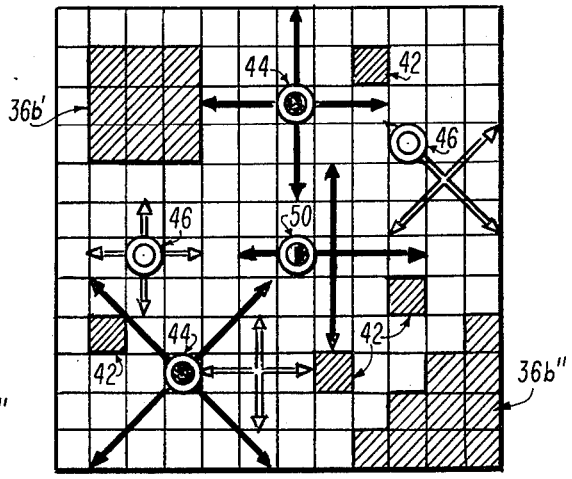
FIG. 16.
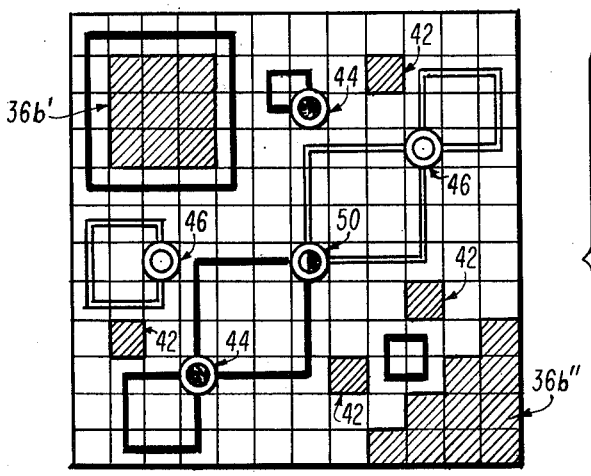
FIG. 17.
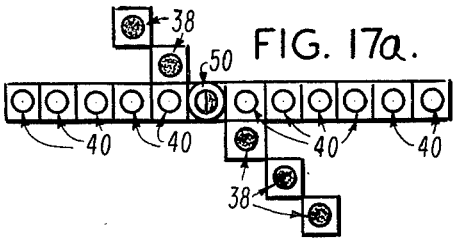
FIG. 17a.
FIG. 17c.
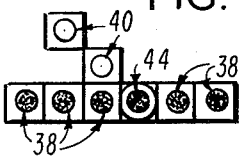

FIG. 17. (CONT.)
FIG. 17b.
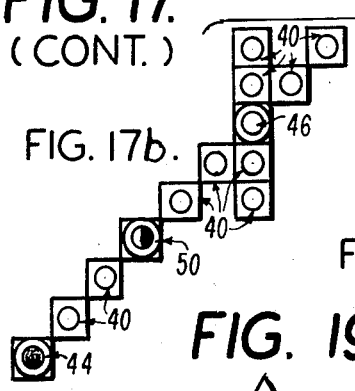
FIG. 17d.
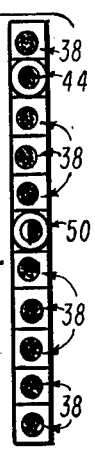
FIG. 18.
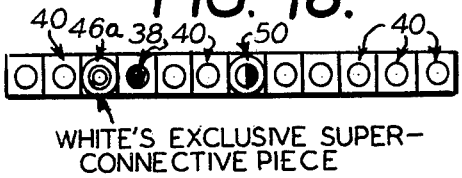
FIG. 19.
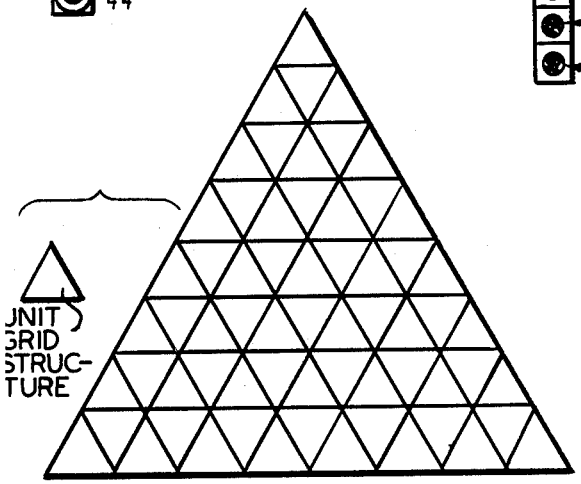
FIG. 20.
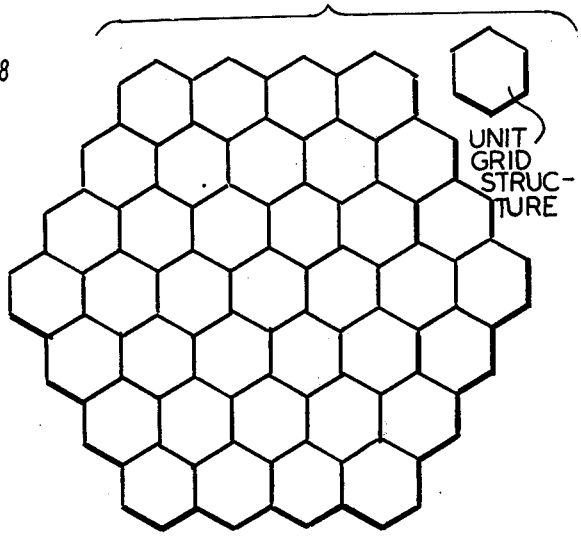
FIG. 21.
FIG. 21a.
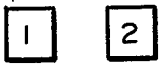
FIG. 21b.
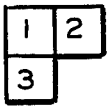
| | | | | | | |
|---|---|---|---|---|---|---|
| 1ST. MOVE | 1 | 2 | 3 | 1,2 | 1,3 | 2,3 |
| 2ND MOVE | 2,3 | 1,3 | 1,2 | 3 | 2 | 1 |
FIG. 21c.
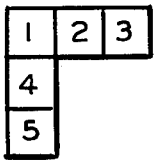
| | | | | | | | |
|---|---|---|---|---|---|---|---|
| 1ST. MOVE | 3 | 1 | 2 | 1,2 | 2,4 | 2,3 | 1,2,3 |
| 2ND MOVE | 5 | 2,4 | 1,3 | 4 | 1,3,5 | 4 1,4,5 | 4,5 |
| | FLP (1) | | | FLP (2) | | | (END) |
FIG. 21d.
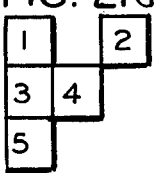
| | | | | | | | | | |
|---|---|---|---|---|---|---|---|---|---|
| 1ST. MOVE | 1 | 2 | 3 | 4 | 5 | 1, 3 | 3,5 | 2,4 | 4,5 |
| 2ND. MOVE | 2 FLP (2) | 1 | 1,4 | 1,3 | 3,4 | 4 FLP (1) | 4 | 3 | 3 |
| | | | |
|---|---|---|---|
| 1ST. MOVE | 3, 4 | 2,4,5 | 1,3,5 |
| 2ND MOVE | 1 2 5 FLP (1) | 1, 3 (END) | 2,4 |

FIG. 24.

FIG. 24a.

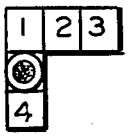

(A) BLACK GOES FIRST:

BLACK'S MOVE: 1,2 2,3 1,2,3 1, 4

WHITE FACING WITH: FLP (1) FWP (1) VWP (1)

(B) WHITE GOES FIRST:

WHITE'S MOVE: 1,2 2,3 1,2,3

BLACK FACING WITH: FLP (1) VWP (1) FWP (1)

FIG. 24b.

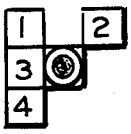

(A) BLACK GOES FIRST:

BLACK'S MOVE: 1, 3 3, 4 1,3,4

WHITE FACING WITH: FLP (1) FWP (1)

(B) WHITE GOES FIRST:

WHITE'S MOVE: 3, 4 1,3,4 1,3

BLACK FACING WITH: FLP (1) FWP (1) VWP (1)

FIG. 24c.

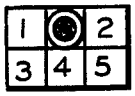

(A) BLACK GOES FIRST:

BLACK'S MOVE: 1,3 2,5 3,4,5 1,2

WHITE FACING WITH: FLP (2) FLP (1) VWP (2)

(B) WHITE GOES FIRST:

WHITE'S MOVE: 4 1,3 2, 5 3,4 4,5 3,4,5

BLACK FACING WITH: FLP FLP (2) VWP

NOTE: IN THE FIGURES SHOWN, ● REPRESENTS BLACK'S CONNECTIVE PIECE, ◎ REPRESENTS WHITE'S CONNECTIVE PIECE.

FIG. 25.

FIG. 25a.

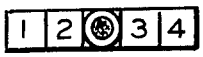

(A) BLACK GOES FIRST:

BLACK'S MOVE: 2,3 1,2,3 1,2

WHITE FACING WITH: FLP (1) FWP (1) VWP (1)

(B) WHITE GOES FIRST:

WHITE'S MOVE: 1 2 1,2 ETC.

BLACK FACING WITH: VWP

FIG. 25b.

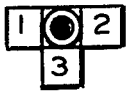

(A) BLACK GOES FIRST:

BLACK'S MOVE: 3 1,3 2,3 1,2 1 2

FLP (1) FWP (1) VWP (B) WHITE GOES FIRST:

WHITE'S MOVE: 1 2 3 1,3 2,3

BLACK FACING WITH: VWP FWP (1)

FIG. 25c.

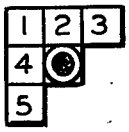

(A) BLACK GOES FIRST:

BLACK'S MOVE: 3,5 2,4 1,2,3 1,4,5

WHITE FACING WITH: FLP (2) FWP (2) VWP (1)

(B) WHITE GOES FIRST:

WHITE'S MOVE: 1 1,2 2,3 2,4 1,2,3

BLACK FACING WITH: FWP (4) VWP

FIG. 25d.

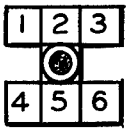

(A) BLACK GOES FIRST:

BLACK'S MOVE: 2,5

WHITE'S MOVE: 1

BLACK'S MOVE: 6 3,4

WHITE FACING WITH: FLP (1) FWP (1)

FIG. 26.

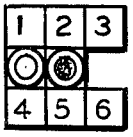

(A) BLACK GOES FIRST:

BLACK'S MOVE: 1,6

WHITE'S MOVE: 2 3 4 5 2,3 4,5

BLACK FACING WITH: VWP (B) WHITE GOES FIRST:

WHITE'S MOVE: 1 3 2 1,2 2,3 1.4 1,2,3

BLACK S' MOVE: 4 4 4,5,6 4,5 4,5 2,5 5

WHITE FACING WITH: FLP FLP (1)

FIG. 27.

FIG. 27a.

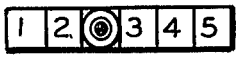

AN EXCLUSIVE SUPERCONNECTIVE PIECE (A) BLACK GOES FIRST:

BLACK'S MOVE: 3 5 2,3,4 1,2,3,4,5 END(WIN)

WHITE FACING WITH: FLP FLP (B) WHITE GOES FIRST:

WHITE'S MOVE: 2 3 3.4 3.4,5

BLACK'S MOVE: 3,4 2,4 1,2,4,5 END (WIN) 2 1,2 END(WIN)

WHITE FACING WITH: FLP (1) FLP (1)

FIG. 27b.

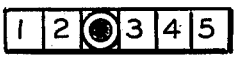

(A) BLACK GOES FIRST:

BLACK'S MOVE: 3 2,3,4 1,2,3,4,5 END (WIN)

WHITE FACING WITH: FLP FLP (1)

(B) WHITE GOES FIRST:

WHITE'S MOVE: 3

BLACK FACING WITH: FLP

FIG. 28.
FIG. 28a.
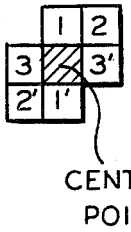
FIG. 28b.
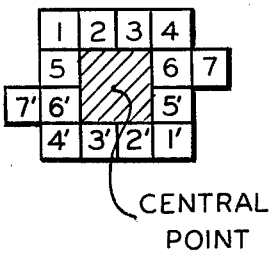
FIG. 28c.
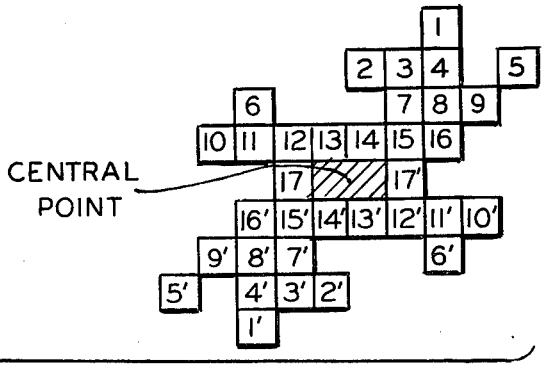
FIG. 29.
FIG. 29a.
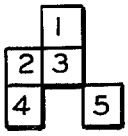
FIG. 29b.
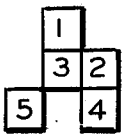
FIG. 29c.
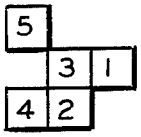
FIG. 29d.
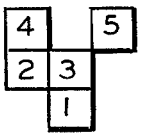
FIG. 29e.
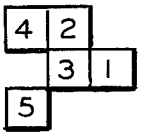
FIG. 29f.
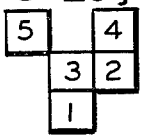
FIG. 29g.
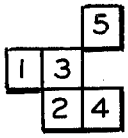
FIG. 29h.
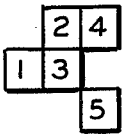
FIG. 29i.
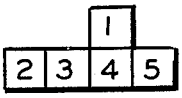
FIG. 29j.
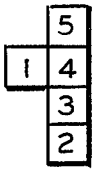
FIG. 29k.
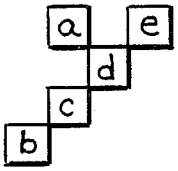
FIG. 30.
FIG. 30a.
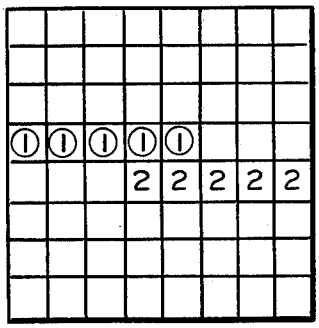
FIG. 30b.
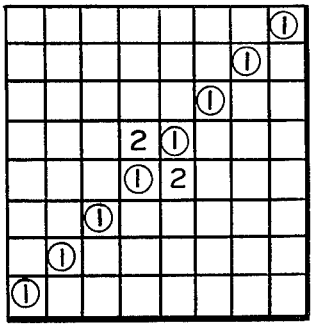
FIG. 30c.
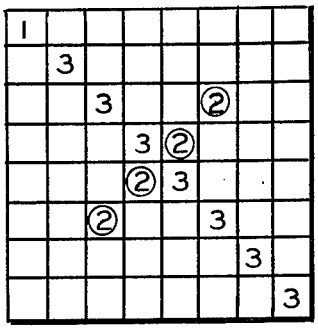
FIG. 30d.
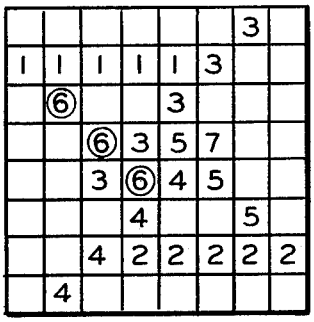
FIG. 30e.
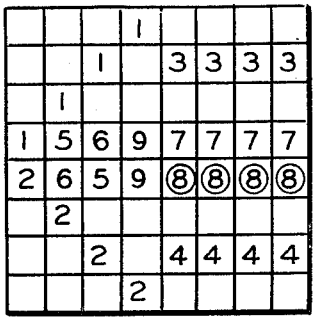
FIG. 30f.
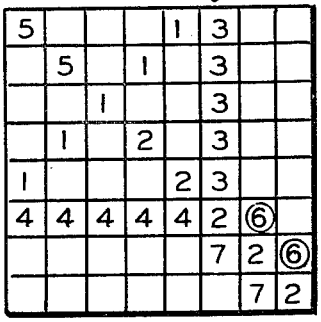

MATHEMATICAL BASED BOARD GAME APPARATUS

BACKGROUND OF THE INVENTION

1. Field of the Invention

The present invention relates to board games and particularly to mathematical based board games.

2. Description of the Prior Art

Board games, and particularly mathematical based board games, are well known in the art. Examples of such prior art mathematical based type of board games are disclosed in U.S. Pat. Nos. 471,666; 3,659,851; 551,278; 3,024,026; 1,206,334; 3,390,472; 3,743,293 and 3,404,890. Several of these prior art board games employ the use of connecting pieces during the playing of the game, such as disclosed in U.S. Pat. Nos. 471,666; 3,404,890; 551,278 and 3,024,026. In addition, mathematical type board games based on the ancient Chinese game of NIM are also well known, such as disclosed in U.S. Pat. Nos. 3,743,293 and 3,390,472. With respect to the ancient game of NIM, this game is normally played by two players with the winner being determined, normally, by the last player to remove the last regular playing piece or, in the alternative, with the object being to be the player who forces his opponent to take the last piece, in that instance the player taking the last piece being the loser. At the start of play, there are normally provided several rows of playing pieces, such as a pyramidal arrangement comprising rows of one, three, five and seven playing pieces, respectively. The players thereafter alternate turns with at least one playing piece being removed from a row by a player during his turn, although the player may remove as many playing pieces as desired from a single row while being restricted from taking any playing pieces from two different rows during a single turn. This prior art ancient game of NIM is a mathematical based game and requires sequential and combinational analysis by the player in order for the player to consistently try to win. The complexity of such analysis can increase significantly as the number of rows and the number of playing pieces in the respective rows increases. However, once you have learned the basic mathematical winning strategy in NIM employing decimal-to-binary conversion, the game becomes no longer challenging as the winning strategy is equally applicable irrespective of the number of rows employed or the number of playing pieces in a row. The game of the present invention, however, as will be explained below, is a mathematical based board game in which the winning strategy may vary from game to game dependent on the ultimate game playing area and the permissible move patterns defined and may readily be handicapped by varying the types and numbers of playing pieces available to the respective players.

SUMMARY OF THE INVENTION

The present invention relates to a mathematical based board game apparatus for at least two players or two teams. The game apparatus includes a matrix grid game board containing a game playing area defined by a plurality of grid units, such as squares, each capable of containing a game playing piece. In the playing area, the placement or removal of a plurality of regular playing pieces takes place in accordance with logically well defined move patterns, such as straight chains of variable length, etc. During alternating designated turns the players completely cover, or uncover if the inverse of the game is played, all of the grid units defining the ultimate playing area to determine the winner of the game.

A plurality of overlays of different configurations are provided for the game board to vary the size and configuration of the playing area from game to game. A game can be played on the board either without any overlay, with a single chosen overlay, or with superimposed multiple chosen overlays with proper relative orientations to obtain the resultant exposed game playing area for initially varying the complexity of each game to be played.

A plurality of blocking pieces deployable by each of the players prior to the playing of the game is also provided for further defining the resultant exposed game playing area configuration and size. Each of the blocking pieces is capable of covering a single previously uncovered grid unit on the resultant exposed playing area for further defining an ultimate game playing area for a single game. The blocking piece which covers a previously uncovered grid unit in the resultant exposed playing area prevents its use by any of the players during the playing of the single game.

In addition, each of the players has a predetermined number of deployable connective game playing pieces for a single game. These connective game playing pieces may be either exclusive connective pieces, neutral connective pieces, exclusive superconnective pieces, or neutral superconnective pieces. The first player's exclusive connective pieces are only deployable in the uncovered grid units in the defined ultimate game playing area for the single game by the first player prior to the playing of the single game for establishing exclusive link nodes for the first player usable during the playing of the single game for enabling the formation of a logically defined move pattern by the first player during his designated turn. Each of the first player's move patterns may be formed to include any number of grid units covered by his exclusive connective pieces as link nodes while preventing the second player from using them. Similarly, the second player's exclusive connective pieces are deployable by the second player only for the second player's exclusive uses in the formation of his move patterns during his turns. The neutral connective pieces are only deployable in the uncovered grid units in the defined ultimate game playing area for the single game by the players prior to the playing of the single game for establishing neutral link nodes equally usable by either player during the playing of the game for enabling the formation of a move pattern during his designated turn. A neutral connective piece is deployable prior to the playing of the single game on a common uncovered grid unit in the defined ultimate game playing area on which the first and second players both deploy their respective exclusive connective pieces and consequently a single piece is used to represent both on that common grid unit.

For more sophisticated playing of the game, the exclusive and neutral superconnective pieces may be used in addition to the exclusive and neutral connective pieces described above. The exclusive superconnective pieces are only deployable by either the first or second player for establishing exclusive extended link nodes for the player deploying these pieces. An exclusive superconnective piece enables the formation of a move pattern during the deploying player's turn by bridging over a predetermined maximum total number of either player's connective, superconnective, or regular game playing pieces which are adjacent to and on either side of the deployed exclusive superconnective piece. A neutral superconnective piece has the same capability of an extended link node as an exclusive superconnective piece, but it can impartially serve either player. The main purpose of using superconnective pieces is to allow the formation of more discontinuous move patterns, thus making it unlikely for an opponent to easily nullify the effectiveness of one player's deployed superconnective piece by making moves to surround such a piece.

Each of the players has a plurality of regular game playing pieces which are only placeable by the respective players on the uncovered grid units in the defined ultimate game playing area for the single game on each of the respective player's designated turns during the playing of a single game. These regular game playing pieces are used for covering either a single uncovered grid unit or a plurality of uncovered grid units in conjunction with the respective player's various types of connective and/or superconnective pieces to form permissible move patterns.

A permissible move pattern can be any of a plurality of patterns well defined and agreed upon by the two players for the execution of the aforementioned covering or uncovering by regular game playing pieces during play in conjunction with the various types of pre-play deployed pieces. Any defined move patterns for use in a single game should include the placement or removal of a single regular playing piece on a single unit of the grid structure as its minimal move, thereby always making possible the total placement or removal of the regular playing pieces over the remaining battlefield configurations in order to determine the final outcome of the game. The definition of a general move can be based on any logical selection or combination of the following possibilities subject to some constraints or boundary conditions if desired: (a) any easily recognized geometrical shapes, such as straight lines, L-shapes, T-shapes, +-shapes, X-shapes, rectangles etc.; (b) any specific set of grid patterns which can be composed based on a well defined computational algorithm; and (c) any specific set of grid patterns which can be defined by tables of binary number sequences with 0 and 1 representing nonoccupancy or occupancy of a grid structure on an orderly arranged array.

The blocking pieces, exclusive connective pieces and neutral connective pieces provide a logic set of game playing pieces for deployment prior to the playing of each single game. Each neutral connective piece corresponds to the logic concept $A+B$, namely A or B; each blocking piece corresponds to the logic cconcept $\overline{A+B}=\overline{A}.\overline{B}$, namely not A and not B; the first player's exclusive connective piece corresponds to the logic concept $A.\overline{B}$, namely A and not B; and the second player's exclusive connective piece corresponds to the logic concept $B.\overline{A}$, namely B and not A, with the symbols A and B corresponding to the first and second players, respectively.

In application to individual games, different combinations of the blocking pieces, the connective pieces and/or superconnective pieces with predetermined distribution of their numbers may be used for deployment prior to the playing of each single game in order to meet different players' interests and requirements, and provide different levels of sophistication. The deployment of these pieces for a single game may be either based on some stranded positional patterns, created by some randomization process or strategically planned by the participating players or teams. For handicap matches, different numbers of connective and/or superconnective pieces may be assigned to the two players or two teams based on their consent. Different move patterns may also be employed based on the players' own choice with mutual agreement.

BRIEF DESCRIPTION OF DRAWINGS

FIG. 12 is a plan view similar to FIG. 10 illustrating a random deployment of four blocking pieces and six exclusive connective pieces on the defined 12-by-12 playing area;

FIG. 13 is a plan view of the game board of FIG. 1, partially diagrammatic, illustrating both effectively and ineffectively located exclusive connective pieces on a 12-by-12 playing area defined by the typical overlay of FIG. 1 with arbitrarily defined blocked zones;

FIG. 14 is a plan view, partially diagrammatic, similar to FIG. 13, illustrating typical moves of variable length straight chains on the 12-by-12 playing area defined by the same overlay as shown in FIG. 7 with various typical blocking pieces and exclusive and neutral connective pieces deployed thereon;

FIG. 15 is a plan view, partially diagrammatic, similar to FIG. 13, illustrating typical moves of variable size +-shape or X-shape on the same playing area with the same overlay and pre-play deployed pieces as shown in FIG. 14;

FIG. 16 is a plan view similar to FIG. 14 illustrating typical moves of variable size square loops on the same playing area with the same overlay and pre-play deployed pieces as shown in FIG. 14;

FIGS. 17A through 17D are fragmentary plan views illustrating the typical set of moves of variable length straight chains involving the use of two players' exclusive and neutral connective pieces shown on the game board of FIG. 14 with FIG. 17A showing one white's move and one black's move, FIG. 17B showing two white's moves, FIG. 17C showing one black's move and one white's move, and FIG. 17D showing one black's move;

FIG. 18 is a fragmentary plan view illustrating a typical white's straight chain move including the use of a white's exclusive superconnective piece;

FIG. 19 is a plan view illustrating another typical game board constructed with triangular grid units instead of the square grid units of FIG. 1;

FIG. 20 is a plan view illustrating still another typical game board constructed with hexagonal grid units instead of the square grid units of FIG. 1;

FIGS. 21A through 21D comprise diagrammatic illustrations of forced losing positions for variable length straight chain moves in accordance with the square grid game apparatus of the present invention;

FIGS. 24A through 24C comprise diagrammatic illustrations of the situations of an ineffectively located black's exclusive connective piece in an isolated playing area in which the black player may be forced to lose in that local zone if the white player goes first;

FIGS. 25A through 25D comprise diagrammatic illustrations of the situations of an effectively located black's exclusive connective piece in an isolated playing area to give the black player a guaranteed winning position (GWP) in which the black player can always win in that playing area independent of which player goes first; among these cases, FIGS. 25D illustrates the outstanding case of a strong guaranteed winning position in which the deploying black player may choose either to win or to lose in that local playing area in accordance with his global strategy;

FIG. 26 comprises a diagrammatic illustration of a local playing area in which two players' exclusive connective pieces coexist illustrating a guaranteed winning position for the black player only but not for the white player, the black's exclusive connective piece being more effectively located than the white's exclusive connective piece;

FIGS. 27A and 27B comprise diagrammatic illustrations showing the greater power of a superconnective piece over an ordinary connective piece, illustrating how the black exclusive superconnective piece makes the situation of FIG. 27A a guaranteed winning position for the black player, whereas the black exclusive ordinary connective piece of FIG. 27B cannot achieve such a position;

FIGS. 28A through 28C comprise diagrammatic illustrations of symmetry within a zone of connected squares in accordance with the game apparatus of the present invention;

FIGS. 29A through 29K comprise diagrammatic illustrations of symmetry between disconnected zones in accordance with the game apparatus of the present invention; and FIGS. 30A through 30F comprise diagrammatic illustrations of exemplary opening moves using a symmetry strategy in accordance with the game apparatus of the present invention.

DETAILED DESCRIPTION OF PREFERRED EMBODIMENTS

Figure 1:
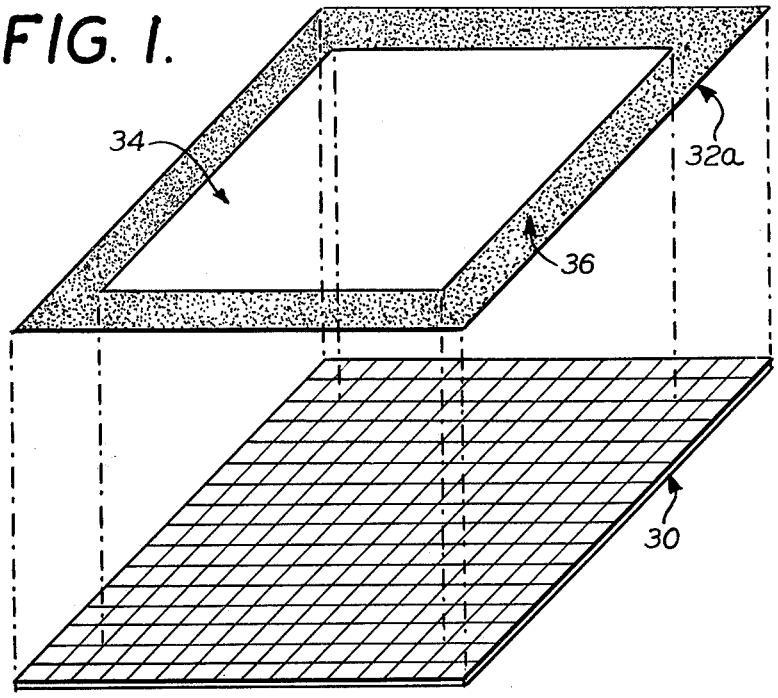
FIG. 1 is an exploded perspective view of a typical game board of the present invention defining a 16-by-16 grid in conjunction with a typical overlay for said game board.

Referring now to the drawings in detail and initially to FIGS. 1 through 20, the preferred embodiment of the game apparatus of the present invention for playing a mathematical based board game is shown. The game is preferably played on a rectangular or square matrix game board 30 having a square grid structure similar to that of a conventional checkerboard comprising a plurality of square grid units. Most preferably, it has been found that the maximum grid area should be defined by a 16-by-16 square grid as illustrated in FIG. 1 although, if desired, any other desired grid unit structure and board configuration, such as those shown in FIGS. 19 and 20 by way of example, could be utilized without departing from the spirit and scope of the present invention. Moreover, preferably overlays formed of a transparent material which will readily adhere to and be removed from the game board 30, such as an overlay 32 composed of poly vinylidene chloride or poly methylmethacrylate, may be utilized to either uniformly decrease the size of the grid square playing area such as illustrated in FIG. 1, or to change the configuration of the exposed game playing area such as illustrated in FIGS. 2 through 9. As shown and preferred in FIG. 1, the overlay 32 preferably has a transparent portion 34 through which the underlying game board 30 is clearly visible and an opaque portion, such as border 36 in the example of FIG. 1, which masks or covers the undesired portions of the underlying game board 30. Thus, in the example of FIG. 1, the overlay 32*a* when placed on underlying game board 30 will expose a 12-by-12 square grid matrix, such as utilized for the examples of FIGS. 6–16. Thus, if an 8-by-8 square grid matrix were desired instead of the exemplary 12-by-12 grid matrix, then the opaque portion 36 forming the border of overlay 32*a* would uniformly be four squares wide. Underlying game board 30 thus preferably provides a square grid matrix of 256 square units on which the playing pieces may be placed in accordance with the game apparatus of the present invention. Of course, as will be explained in greater detail hereinafter, if a given square grid unit is either previously masked by an overlay, covered by a blocking piece, or covered by an exclusive connective piece belonging to the other player or, of course, previously occupied by another player's move, then that square grid unit is no longer available.

Figure 2:
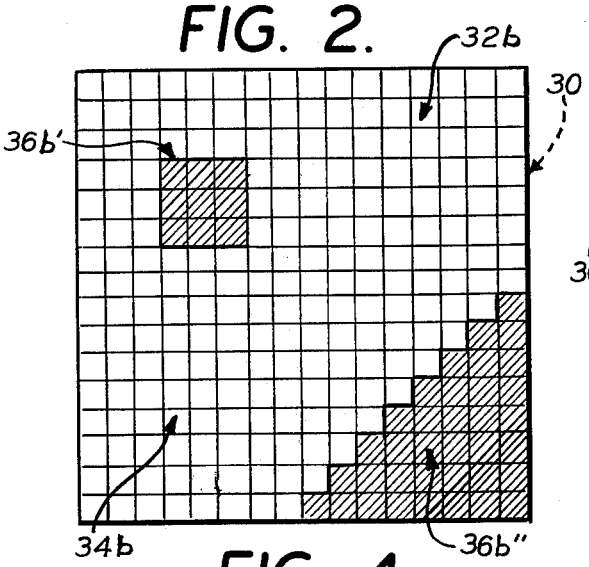
FIG. 2 is a plan view of the game board of FIG. 1 with a different overlay superimposed thereon.
Figure 3:
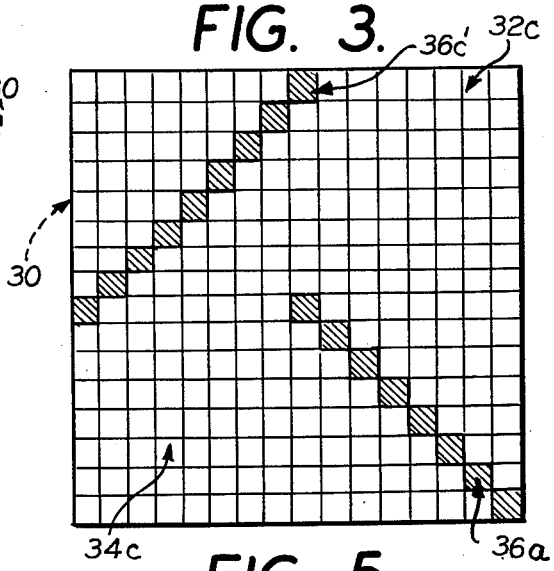
FIG. 3 is a plan view similar to FIG. 2 with still a different overlay superimposed on the game board of FIG. 1.
Figure 4:
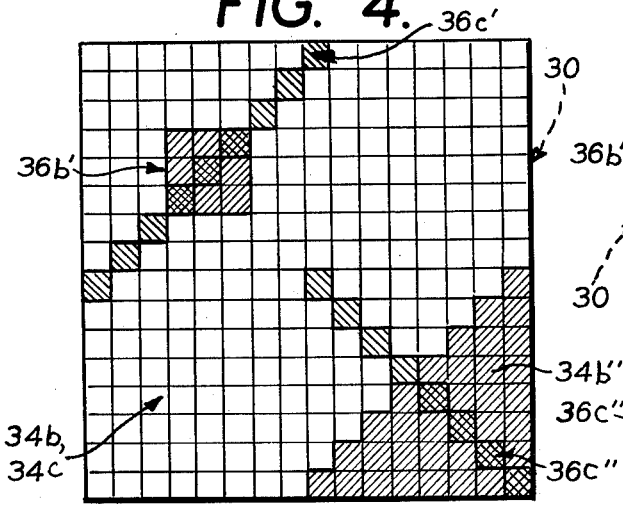
FIG. 4 is a plan view similar to FIG. 2 with the overlay of FIG. 3 superimposed on the overlay of FIG. 2 and subsequently superimposed on the game board of FIG. 1.
Figure 5:
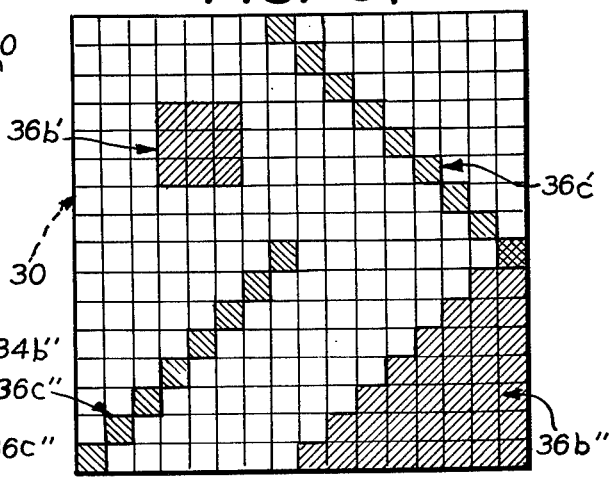
FIG. 5 is a plan view similar to FIG. 2 with the overlay of FIG. 2 superimposed on the game board of FIG. 1 and with the overlay of FIG. 3 rotated 90 degrees from that shown in FIG. 3 and subsequently superimposed on the overlay of FIG. 2.

Preferably, all of the overlays 32 employed in the game apparatus of the present invention, such as the overlays illustrated in FIGS. 2 through 5, are equal in circumference to each other and to underlying game board 30. As stated above, in addition to reducing the field size of the exposed underlying game board 30, the various overlays 32 provide different inner configurations varying the complexity of the game which, as will be described in greater detail hereinafter, can be varied from game to game merely by changing the overlays 32. Moreover, as illustrated in FIGS. 4 and 5 by way of example, a plurality of overlays 32 may be superimposed at the same time on the underlying game board 30 to still further vary the ultimate playing configuration. The transparent portions 34 on the various overlays 32 which may be employed in the game apparatus of the present invention may have patterns of different types such as symmetrical patterns, pseudosymmetrical patterns, unsymmetrical patterns or various combinations thereof. Thus, by utilizing the overlays 32 of the present invention, an almost limitless number of different playing area configurations can be constructed such as by the aforementioned superimposition of multiple layers of overlays 32 with different combinations and different orientations. Thus, for example, FIGS. 2 and 3 illustrate typical exemplary overlays for use on the underlying game board 30 with FIGS. 2 and 3 each illustrating the overlay **32*b* and 32*c*, respectively, in place on the underlying game board 30. Thus, for example, overlay 32*b* contains two opaque portions 36*b*' and 36*b*'' and transparent portion 34*b*, the transparent portion 34*b* exposing a particular size and configuration playing area on the underlying game board 30 for initially varying the complexity of the game to be played in accordance with the resultant exposed playing area underlying portion 34*b*. Similarly, FIG. 3 illustrates a different resultant exposed playing area underlying transparent portion 34*c* resulting from the portions of underlying game board 30 masked or covered by opaque portions 36*c*' and 36*c*'' of overlay 32*c*. FIG. 4 illustrates still another typical different resultant exposed playing area resulting from the superimposition of the overlays of FIGS. 2 and 3 on the underlying game board 30. In the example of FIG. 4, the orientation of the overlays as shown in FIGS. 2 and 3 is presumed and the resultant exposed playing area results from the transparent portions resulting from the overlap of transparent portions 34*b* and 34*c*. In addition, in the example of FIG. 4, the crossed hatch areas indicate the overlap of the opaque portions of 36*b*' and 36*c*', and 36*b*'' and 36*c*''. FIG. 5 illustrates still another typical resultant exposed playing area resulting from the superimposing of the overlays 32*b* and 32*c* of FIGS. 2 and 3, respectively, on the underlying game board 30 with, however, the overlay 32*c* rotated 90° from that illustrated in FIGS. 3 and 4 and with the overlay 32*b* of FIG. 2 remaining in the same orientation as illustrated in FIGS. 2 and 4. Thus, as shown in FIG. 5, a different resultant exposed playing area results from the overlap of transparent portions 34*b* and 34*c*. It should be noted that the combinations illustrated in FIGS. 2 through 5** are merely illustrative and that numerous other combinations of overlays and numerous other different configuration overlays having different configurations of opaque portions and transparent portions can be constructed without departing from the spirit and scope of the present invention. In addition, it should be noted that in selecting an overlay or constructing an initial battle field or playing area in accordance with the game apparatus of the present invention, configurations involving certain types of symmetry or pseudosymmetry should be avoided as they may significantly impair the strategy involved in playing the game, as will be described in greater detail hereinafter, such as, for example, providing an unblocked rectangular field or playing area having an odd number of rows or columns.

Figure 6:
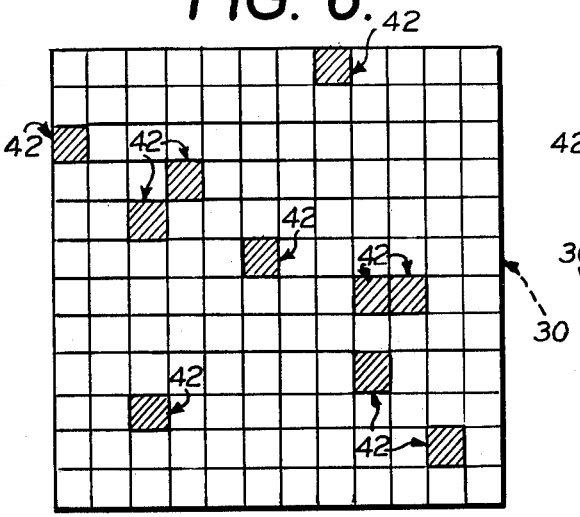
FIG. 6 is a plan view of the game board of FIG. 1 illustrating blocking pieces randomly deployed in the 12-by-12 grid playing area defined by the typical overlay of FIG. 1.
Figure 7:
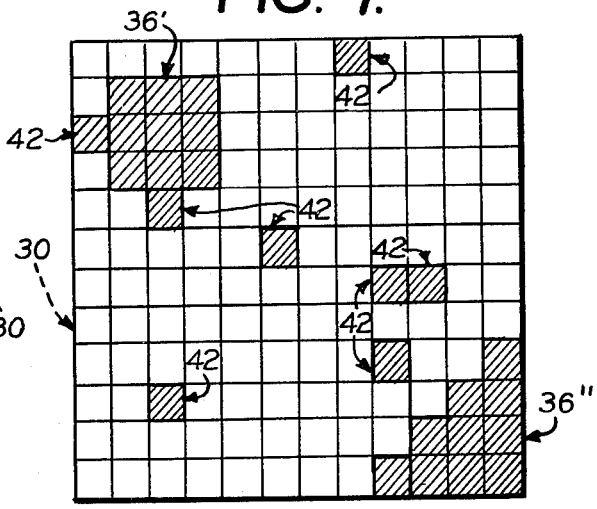
FIG. 7 is a plan view of the game board of FIG. 1 illustrating blocking pieces randomly deployed in the 12-by-12 grid playing area defined by the superimposition of the typical overlay of FIG. 1 and the overlay of FIG. 2.
Figure 8:
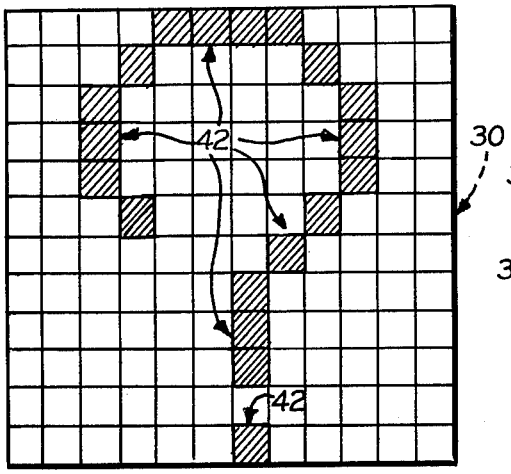
FIG. 8 is a plan view of the game board of FIG. 1 illustrating blocking pieces pseudo symmetrically deployed on a 12-by-12 grid playing area defined by the typical overlay of FIG. 1.
Figure 9:
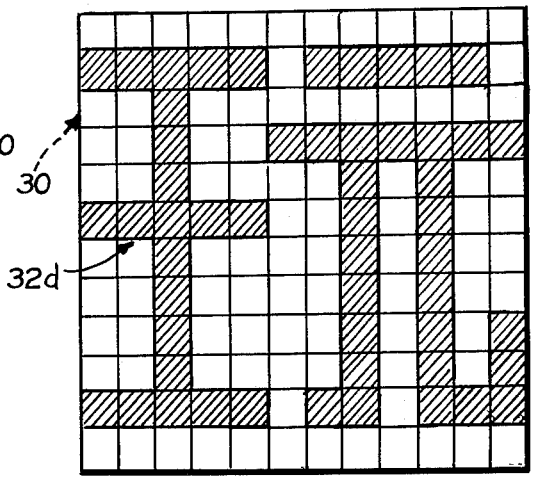
FIG. 9 is a plan view of the game board of FIG. 1 illustrating an arbitrarily defined playing area within the 12-by-12 grid defined by the typical overlay of FIG. 1, which area is constructed based on a Chinese character meaning "to play"
Figure 10:
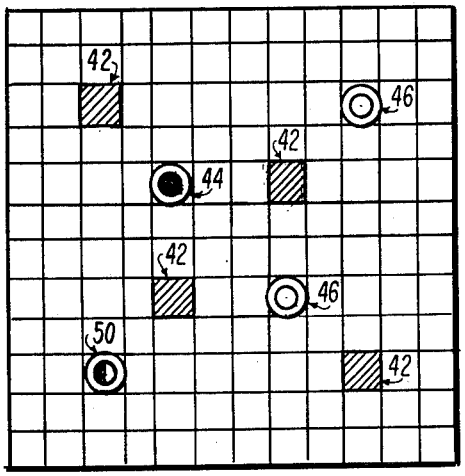
FIG. 10 is a plan view of the game board of FIG. 1 illustrating a standard pre-play deployment of four blocking pieces, three exclusive connective pieces and one neutral connective piece on a 12-by-12 playing area defined by the typical overlay of FIG. 1.
Figure 11:
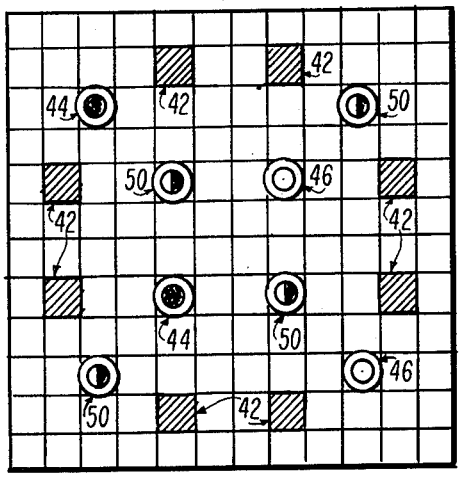
FIG. 11 is a plan view similar to FIG. 10 illustrating another standard pre-play deployment of eight blocking pieces, four exclusive connective pieces and four neutral connective pieces on the defined 12-by-12 playing area.
Figure 22:
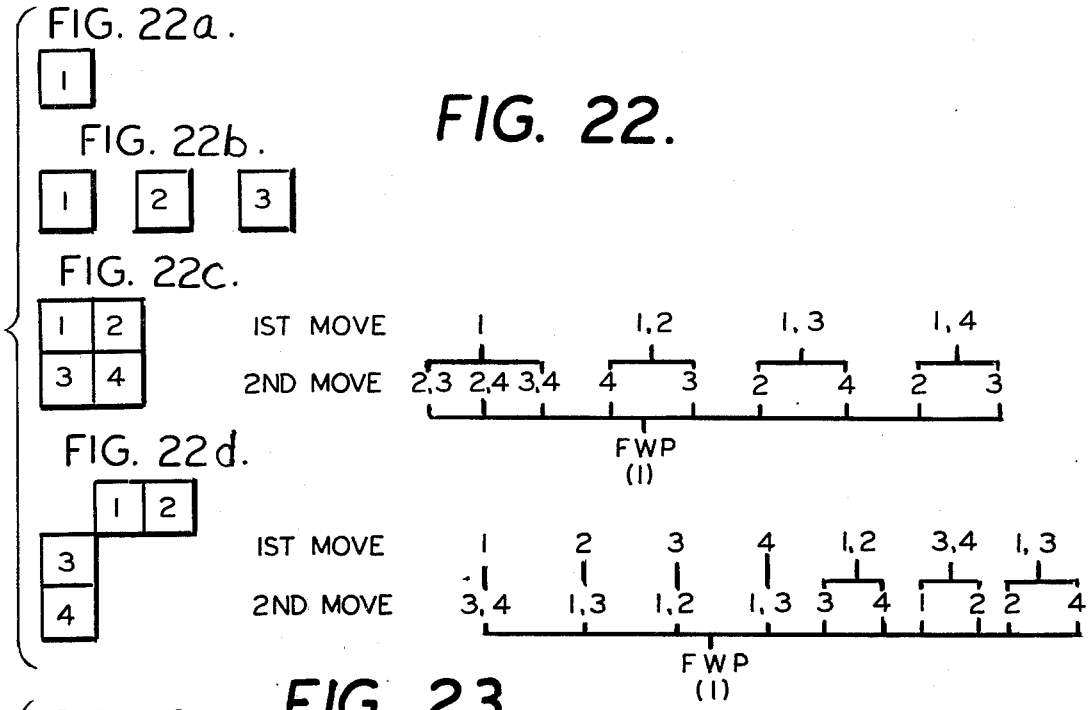
FIGS. 22A through 22D comprise diagrammatic illustrations of forced winning positions for variable length straight chain moves in accordance with the square grid game apparatus of the present invention.
Figure 23:
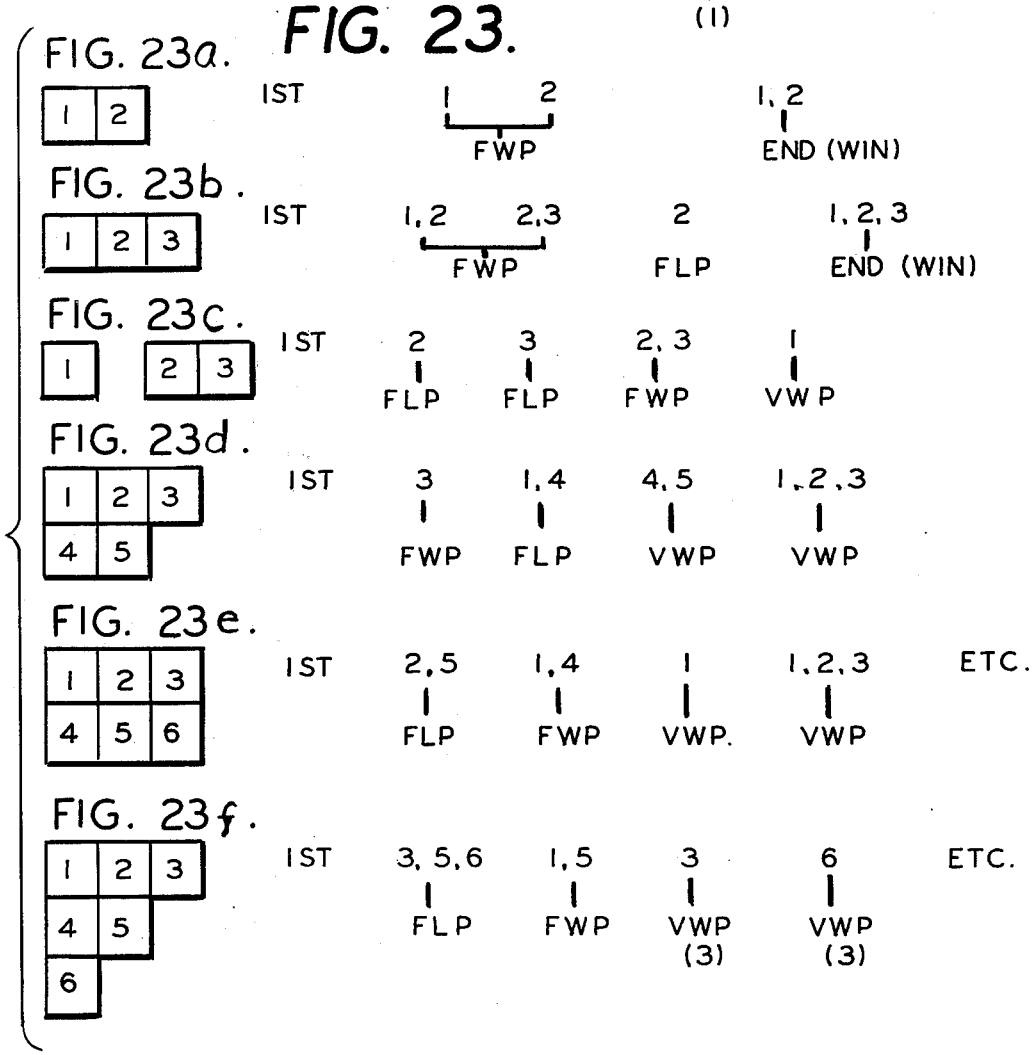
FIGS. 23A through 23F comprise diagrammatic illustrations of voluntary winning positions for variable length straight chain moves in accordance with the square grid game apparatus of the present invention.

The game apparatus of the present invention is preferably played by two players or two teams by utilizing three different types of basic game playing pieces. The game playing pieces for each of the players are preferably distinctive to the player such as by employing regular game playing pieces of two different colors, such as white and black, with the white pieces being for one player or team and the black pieces being for the other player or team. As will be described in greater detail hereinafter, each of these regular game playing pieces 38 and 40 for black and white, respectively, is placeable on a single grid square during the course of normal play after the initial deployment of blocking pieces and connective pieces, to be described in greater detail hereinafter, prior to the actual playing of a single game, with these blocking and connective pieces being deployed in the resultant exposed playing area resulting from the deployment of one or more overlays 32 on the underlying game board 30. The blocking pieces 42, a predetermined plurality of which are provided to each player, each preferably represent a square or other configuration and unit size and preferably have the same color as the opaque portions of the overlay 32. These blocking pieces 42 are preferably used by the players to further define the resultant exposed game playing area configuration and size with each of the blocking pieces 42 being capable of covering a single previously uncovered grid unit on the matrix grid game board resultant exposed playing area for further defining an ultimate game playing area for a single game. The blocking pieces 42 can cover a previously exposed uncovered grid unit in the resultant exposed playing area after an overlay has been employed or, if desired, and no overlay 32 is employed, the blocking pieces 42 can cover any uncovered grid unit on the game board 30. In either instance, the blocking piece 42 prevents the use of the covered grid unit by any of the players during the playing of the single game. FIG. 6 illustrates a random deployment of solely blocking pieces 42 in the resultant 12-by-12 playing area on the game board 30 arising from the use of the overlay 32 of FIG. 1 on the game board 30. FIG. 7 also illustrates the use of solely blocking pieces 42 in a resultant 12-by-12 playing area arising from the combination of the overlay 32 of FIG. 1 with another overlay having opaque areas 36' and 36'' and with the blocking pieces 42 being randomly deployed on the playing area. FIG. 8 illustrates the use of pseudosymmetrically deployed blocking pieces 42 in the form of a question mark in the resultant exposed 12-by-12 playing area of FIG. 1. In the example of FIG. 7, the resultant exposed playing area is thus further defined by the deployment of the blocking pieces 42 to define an ultimate game playing area for a single game. FIG. 9 illustrates still another example of an overlay **32*d* superimposed on the 12-by-12 playing area of FIG. 1** for further defining the exposed game playing area based on a Chinese character meaning "to play".

Another type of distinctive game playing piece which is deployable by the players prior to the actual playing of the single game is termed a connective piece which, as will be described in greater detail hereinafter, establishes a link node usable during the playing of the single game for enabling the formation of a defined move pattern,such as a continuous linked chain, during a given turn. These connective game playing pieces are preferably of two types, termed exclusive connective game playing pieces and neutral connective game playing pieces. As will be described in greater detail hereinafter, the neutral connective game playing pieces may be used as link nodes by either player whereas the exclusive connective game playing pieces may be used as link nodes solely by the player who deploys that exclusive connective game playing piece. With respect to the exclusive connective game playing pieces, these are preferably distinguished in the same manner as the regular game playing pieces, such as by the use of the two colors white and black, with each player being given a predetermined number of connective game playing pieces which, as will be described in greater detail hereinafter, may vary in accordance with the handicap relationship between the players. These exclusive connective game playing pieces 44 and 46 for black and white, respectively, are only for pre-play deployment on the game board 30 and, accordingly, are further distinguished from the regular game playing pieces, these exclusive connective game playing pieces 44 and 46 comprising positional privilege pieces giving the respective player to whom they belong the privilege of forming a move pattern by bridging his regular playing pieces 38 or 40 over these connective playing pieces 44 and 46, respectively, as will be described in greater detail hereinafter with reference to FIGS. 10 through 18, while not allowing his opponent to accomplish this. The exclusive connective game playing piece acts as a blocking piece of the opponent in that the opponent's placement of his regular game playing pieces must stop before this exclusive connective game playing piece and cannot bridge over it. If in pre-play deployment, both players happen to choose the same grid unit for placing a connective game playing piece thereon, then a neutral connective game playing piece 50 is instead placed on this grid unit. This neutral connective game playing piece forms a link node for either of the players to enable both players the privilege of forming a move pattern by bridging their regular playing pieces over such a neutral connective piece. These neutral connective pieces 50 are also preferably distinguished such as by coloring them both black and white, such a neutral connective game playing piece 50 also only being for pre-play deployment on the board 30. Thus, the blocking pieces 42, the exclusive connective pieces 44 and 46 and the neutral connective pieces 50 cooperate to form a logic set of link-connecting pieces in the following manner. While the white regular game playing piece 40 and the black regular game playing piece 38 are represented by the symbols A and B, respectively, the neutral connective game playing piece 50 corresponds to the logic concept $A+B$, which means A or B, the blocking piece 42 corresponds to the logic concept $\overline{A+B}=\bar{A}.\bar{B}$, which means not A and not B, the white exclusive connective piece 46 corresponds to the logic concept $A.\bar{B}$, which means A and not B, and the black exclusive connective piece 44 corresponds to the logic concept $B.\bar{A}$ which means B and not A. Of course, these logic concepts can be generalized and applied to the case of games involving more than two players with greater resultant combinations.

Referring now to FIGS. 10–16, the diagrammatic illustration of the pre-play deployment of an overlay, blocking pieces 42, exclusive connective game playing pieces 44 and 46 and neutral connective game playing pieces 50 on underlying game board 30 is shown. Typical straight chain type moves using these pieces are diagrammatically illustrated by the arrows in FIG. 14 and by the fragmentary views of FIGS. 17A, 17B, 17C, 17D and 18. By way of example, an overlay similar to **32*b* is employed on the underlying game board 30 in FIG. 14. In addition, blocking pieces 42 are randomly deployed on the resultant exposed playing area defined by transparent portion 34*b* in order to further define the resultant exposed playing area and provide an ultimate game playing area. Thereafter, as further shown in FIG. 13 or 14 for example, a plurality of black exclusive connective game playing pieces 44 are deployed in the ultimate defined game playing area. A plurality of white exclusive connective game playing pieces 46 are also deployed in the ultimate defined game playing area shown by way of example in FIGS. 13 and 14. In addition, neutral connective game playing pieces 50 are deployed in the ultimate defined game playing areaa shown by way of example in FIGS. 13 and 14. FIGS. 13 and 14 illustrate typical moves by black and white using connective piece 44 and 46 as exclusive link nodes to form an extended link chain type move pattern comprising a plurality of regular game playing pieces 38 or 40, respectively. As also shown in FIGS. 13 and 14, on white's move, such piece 44 cannot be used as a link node and, accordingly, a chain of white regular game pieces 40 must end at this node 44. Similarly, FIGS. 13 and 14 also illustrate examples of typical moves by white forming an extended link chain using a white exclusive connective piece 46 as an exclusive link node for white. Thus, black's chain of regular game playing pieces 38 must stop at such a link node 46 whereas, white's regular game playing pieces 40 can bridge over this piece 46. FIG. 14 illustrates the example of typical moves by black and white when a neutral connective game playing piece 50 is employed. In this instance, piece 50 forms a neutral or common link node for both black and white with each of the players bridging over this link node 50 to form extended link chain type of move patterns, with the black extended link chain comprising a plurality of black regular game playing pieces 38 and with the white extended link chain comprising a plurality of white regular game playing pieces 40. FIGS. 15 and 16 illustrate other typical move patterns, with FIG. 15 illustrating variable size symmetrical +-shapes or X-shapes and with FIG. 16** illustrating variable size square loops.

FIGS. 17A–17D illustrate typical sets of moves involving the various connective pieces on the game board of FIG. 14.

FIG. 17A illustrates typical moves by black and white using exclusive and neutral connective pieces by white, with black using the same neutral connective piece, with extended chains being formed by both black and white. FIG. 17B illustrates extended chains formed by white and FIGS. 17C and D illustrate typical extended chains formed by black.

Various other move combinations not illustrated are, of course, possible without departing from the spirit and scope of the present invention, the above illustrations merely being exemplary. As will be described in greater detail hereinafter, the formation of move patterns such as extended chains is an important part of the strategy employed in playing the game of the present invention.

In addition to the game playing pieces discussed above, if desired, superconnective game playing pieces may be used by the players which would allow a player to bridge his regular game playing pieces over one or more of either his own or his opponent's pieces to form a more discontinuous link chain thus making it unlikely for an opponent to easily nullify the effectiveness of the superconnective piece by making moves to surround such a piece. Such superconnective game playing pieces can be either exclusive or neutral with respect to the respective players, in the same manner as the aforementioned exclusive and neutral connective game playing pieces. Thus, if an exclusive superconnective game playing piece is deployed prior to the playing of the game in the same manner as the exclusive connective game playing pieces of a player, and if the opponent should place, for example, one of his regular game playing pieces adjacent to this superconnective piece, then assuming the exclusive superconnective piece is designed to allow the deploying player to jump or bridge over one adjacent regular game playing piece of an opponent, an extended link chain may be formed such as that illustrated in FIG. 18 by white, by way of example, where an exclusive superconnective game playing piece 46*a* is employed in place of an exclusive connective game playing piece 46 of FIG. 17A for example. Thus, as shown in FIG. 18, the extended discontinuous link chain formed by white on a single move, in the example shown, would enable white to bridge over the adjacent deployed black regular game playing piece 38 to subsequently connect with other white regular game playing pieces 40. In addition, neutral superconnective game playing pieces are also provided for establishing neutral extended link nodes to impartially serve both players.

In the normal version of the game of the present invention, the objective of the game is for the player to occupy the last remaining grid unit or group of grid units in the ultimate defined playing area whereas in its misere version, the objective is for the player to force his opponent to occupy the last remaining grid unit in the ultimate defined playing area; in either version, the one who succeeds in accomplishing the above is the winner of the game. At the beginning of the game, the players decide on consent to choose their move patterns, a certain board size, such as 16-by-16, 12-by-12 or 8-by-8, the desired overlays 32 to be employed to define a resultant exposed playing area and how the overlays 32 are to be employed to provide the resultant exposed playing area. Depending on whether the game is to be a handicap or non-handicap match, as will be described in greater detail hereinafter, the players then decide how many blocking pieces and/or connective pieces to use for pre-play deployment. Thus, if the match is a non-handicap match, then the players will each preferably have the same amount of exclusive connective game playing pieces, whereas if the match is a handicap match, the more skilled the player is as compared with his opponent, the less the number of exclusive connective game playing pieces that skilled player will have depending on a pre-arranged handicap relationship. In conventional fashion, the player who goes first is decided. Thereafter, if the pre-play blocking pieces and connective pieces are to be strategically deployed by the players, then the blocking pieces 42 are first alternately deployed by the players to further define the resultant exposed game playing area configuration and size to define an ultimate game playing area for a given game, the connective and/or superconnective game playing pieces 44, 46 and 50 thereafter being next deployed in the ultimate defined game playing area dependent on the individual player's strategy as will be discussed in greater detail hereinafter. Preferably, the two players alternately place their blocking or connective pieces one piece at a time and, as stated above, if the blocking pieces 42 are to be alternately deployed by the players, all of the blocking pieces should preferably be deployed before the deployment of the connective pieces by the players. In addition, as stated above, neutral connective pieces 50 are placed on those common grid units upon which both players wish to deploy a connective piece. In a handicap match in which the two players use different numbers of connective pieces, the player who has more connective pieces should preferably place all his extra number of such pieces before the two players start their alternate placement of pieces with the sequence of pre-play deployments of connective pieces between the two players being the same as that of the subsequent plays during the playing of the single game. Alternatively, the players may work out their deployments independently and mark them down on separate pieces of paper. Thereafter, both pieces of paper are uncovered and the blocking and connective pieces are deployed in accordance with the deployments indicated on the papers, with neutral connective pieces 50 being placed on grid units upon which both players have indicated their intention to deploy a connective piece and, of course, with only one blocking piece 42 being deployed on a grid unit even if both players indicate their intention to deploy a blocking piece on that grid unit. Preferably, during the playing of the game, the white regular game playing pieces go first and then the black, with the players taking turns in placing their regular game playing pieces 40 and 38, respectively, consecutively on unoccupied adjacent grid units in the ultimate defined playing area to form a defined move pattern, such as a straight chain or row either horizontally, vertically, or diagonally during each move, with no player being allowed to skip any move. During normal play, such move patterns or chains can be as large or as long as the unblocked and unoccupied ultimate game playing area permit. As stated above, play continues until one player occupies the last remaining grid unit or group of grid units in the ultimate defined playing area, this player being the winner in the normal version of the game. In one version of a handicap game, the players may be allowed to place down different maximum numbers of regular game playing pieces per move with the stronger player being allowed a smaller maximum number. In any event, during his turn or move, the player must place at least one regular game playing piece on an uncovered grid unit or a plurality of regular game playing pieces on a plurality of uncovered grid units with the various types of connective pieces allowing the formation of the different types of move patterns discussed above by way of example.

Prior to the playing of the game, the players may mutually agree on move patterns, board size, whether the game is to be a normal game or a misere version, the use of overlays, the predetermined numbers of blocking and/or connective pieces and how the blocking and/or connective pieces are deployed. As stated above, the players may change the initial field configuration defining the resultant exposed game playing area at the beginning of a new game by using different overlays and different superpositions thereof. In addition, the ultimate defined game playing area can be varied by changing the number and/or location of the deployed blocking pieces. The deployment of the blocking and/or connective pieces can be either chosen in accordance with some standard positional patterns, randomly located based on throwing of dice or drawing of cards, or strategically planned by the players. Moreover, if desired, the players can choose to subdivide the field into two or more regions to allow mixed strategic, standard and random pre-play deployments of blocking and/or connective pieces. In addition, different regions can be assigned to have different types of configurational symmetry, asymmetry, or pseudosymmetry to adapt forced strategic play. With respect to the aforementioned handicapping, various handicapping procedures can be followed, such as the previously mentioned examples wherein the two players may be allowed to have different numbers of connective pieces with the stronger player being given fewer connective pieces than the weaker one or wherein the two players may be allowed to place different maximum numbers of pieces per move, or various combinations of these approaches.

As previously stated, a reversed game version of the preferred game of the present invention can be played after the field or ultimate defined playing area is completely filled up by either the normal or the misere versions. In playing this reversed version, the two players alternately take turns to remove consecutive regular game playing pieces in defined move patterns and are permitted to take advantage of their particular exclusive or the neutral connective pieces in determining the extent of the move patterns which a player can remove on a given turn. In the normal version of this reversed play, the player who picks up the last remaining piece or pieces is the winner whereas in the misere version, the player who picks up the last remaining piece will be the loser. It should be noted that, in this reversed play version, any single color of regular pieces suffice while the concept of blocking pieces and connective pieces of different colors are still equally as effective in terms of strategic play, handicapping, etc.

Strategy

By way of example, suggested mathematical based strategies which may be employed in playing the preferred game of the present invention will be discussed below with reference to FIGS. 21 through 30. For this preferred game, a matrix grid board with all square grid units is employed and the move patterns are limited to straight chains of variable length, either horizontal, vertical or diagonal. These suggested strategies are merely exemplary and represent only basic approaches. These basic approaches are based on the assumption that they are confined to the normal version of playing between two players employing an ultimate defined playing area provided through the use of overlays 32 an/or blocking pieces 42 and in which connective pieces 44, 46 or 50 may be employed.

One of the basic principles of strategy necessary in the playing of any game, particularly a mathematical based game, is the ability to recognize winning and losing positions. In the game of the present invention, as the game proceeds, the players will become faced with more and more separated small "battle zones" wherein it becomes vitally important to the players to recognize the winning or losing patterns of the individual zones. These individual zones are defined as comprising a configuration of a finite number of connected squares which have no connection with any squares outside a given zone. However, since it is sometimes more convenient to consider a combination of certain separate or disconnected zones as a single configuration, such a combination will also be treated below conceptually as a single zone.

For any given of arbitrary configuration there may exist either a unique solution, multiple solutions, or no solution at all for a move for the player who goes first to assure a win. In other words, a given configuration can be either a winning or a losing position for the player who goes first and, hence, a losing or a winning position, correspondingly, for the player who goes second based, of course, on the assumption that both players know how to make the best moves at any given point in the game. Considering a basic strategy for deployment of regular game playing pieces over multiple zones containing no connective pieces, first these winning and losing positions may be classified into three basic categories termed a "forced losing position" or "FLP", a "forced winning position" or "FWP", and a "voluntary winning position" or "VWP". All of the below definitions relating to these positions are in reference to the player who goes first. A forced losing position is a configuration in which a player who goes first can always be forced by his opponent to lose within the configuration itself, assuming of course that his opponent responds with the correct moves. Thus, a forced losing position will always create another forced losing position after the first player moves and no matter how the second player responds. FIGS. 21A through 21D are illustrative examples of forced losing positions. It should be noted that, such as illustrated in FIG. 21A, a zone consisting of any even number of disconnected single squares is always a forced losing position. With respect to FIGS. 21A through 21D, it should be remembered that, for purposes of this exemplary discussion, the assumption is that the last player to occupy a square or plurality of squares is winner for that position, and the squares are numbered so as to correspond to the symbols used in the adjacent "move trees". These so called "move trees" show all possible moves and countermoves that may be taken by the two players, always ending with the first player losing.

A forced winning position is a configuration in which the player who goes first can always move to convert it into a forced losing position for his opponent; no matter what moves the first player makes his opponent can always force him to win by responding with the correct move. Thus, a forced winning position will always create another forced winning position after the first player moves and his opponent correctly responds to force him to win. FIGS. 22A through 22D diagrammatically illustrate forced winning positions, with the squares being numbered and with "move trees" being adjacent to these squares to illustrate all possible moves and countermoves that may be taken by the two players always ending with the first player winning. Thus, it should be noted that a single square is the extreme case of a forced winning position and that a zone consisting of any odd number of disconnected single squares is a forced winning position since, in the example given, the winner is defined as the last player to occupy a square.

A voluntary winning position is a configuration in which the first player can make a move to convert it into either a forced losing position or a forced winning position or another voluntary winning position of reduced size. It is considered a winning position since it can be converted into a forced losing position for the second player and, hence, assure the first player a win and it is considered a voluntary position since it can also be converted either into a forced winning position to force the second player to win or into another voluntary winning position to give the second player a choice either to win or lose. In reality, such a voluntary winning position may also considered a voluntary losing position since it can become a losing position to the first player after his opponent responds if he chooses to convert it into a forced winning position for his opponent. Illustrations of voluntary winning positions are shown in FIGS. 23A through 23F with the squares being numbered and with "move tress" showing all possible moves and countermoves that may be taken by the two players being adjacent thereto.

During the play of the game, the players are faced with a dynamically changing battle field involving numbers of scattered multiple zones which change in configuration from one move to another as pieces are deployed on the game board in the ultimate defined playing area. Players normally make partitioning moves trying to subdivide the defined playing area into smaller isolated zones until their sizes become sufficiently small on their configurations possess certain properties, such as symmetry, so that the zone can be readily recognized and controlled in terms of the aforementioned winning or losing positions. By way of example, several different situations shall be discussed below. For example, if there are multiple zones all consisting of forced losing positions, the player facing this situation will definitely lose since in response to any move he makes his opponent may make a proper countermove in the same zone to create another forced losing position of a reduced size, this position thereby being an overall losing position for the player who goes first if his opponent responds correctly to every move. If the multiple zones consist of all forced losing positions and forced winning positions with no voluntary winning positions, the overall position is a winning one for the first player if the number of forced winning positions is odd and a losing one if the number of forced winning positions is even since every pair of forced winning positions makes an equivalent forced losing position. The reason for this is that after the second player forces the first player to win or make the last move in the first zone, he will become the first player to make the first move and win in the second zone. Thus, if the total number of forced winning positions is odd, after the second player wins in all pairs of forced winning positions, the first player will win in the last remaining forced winning position, the situation being the same no matter how many forced losing positions exist together with the forced winning positions and no matter how the players jump from one of these zones to another. Thus, wherever possible, the player should always let his opponent face an even number of forced winning positions and he himself an odd number of forced winning positions.

The situation in which multiple zones exist consisting of forced losing positions, forced winning positions and voluntary winning positions is the most complex situation in these examples. since the voluntary winning positions contribute to an uncertainty regarding the overall winning or losing position. This uncertainty increases when the number of voluntary winning positions is greater than two. If, however, only one voluntary winning position exists mixed with forced losing positions and forced winning positions, the player should immediately convert the voluntary winning position into either a forced losing position or a forced winning position depending on whether the total number of forced winning positions is even or odd, respectively, thereby giving his opponent an overall losing position as discussed above. If there are two voluntary winning positions, the player should avoid reducing one voluntary position to either a forced losing position or a forced winning position since this would give his opponent an opportunity to convert the other voluntary winning position to make an overall winning position as discussed above. Thus, in such an instance, the player should simply reduce one voluntary winning position to another voluntary winning position of smaller size, if possible, in order to keep the situation uncertain and not give his opponent an immediate opportunity to win. A special and simple case of voluntary winning positions particularly worth noting is that of any horizontal, vertical or diagonal chain formed as a straight line with two or more grid squares. Any isolated straight line chain is a winning position. Only the extreme case of a single square is a forced winning position, any chain with no less than two consecutive squares being a voluntary winning position since it can either be completely filled up in one move or converted into a forced winning position by being left with only one square, or converted into another voluntary winning position by being left with two or more squares if possible.

So far we have considered strategy for the specific version of play on playing areas with no connective pieces. In a playing area with even a single connective piece, the situation can be drastically changed if the connective piece is effectively located. A connective piece may be capable of performing its function only if it has at least one uncovered square on each side of it, forming a straight chain bridging over it. A connective piece sometimes allows more than one potential straight chain to bridge over it; and the more such chains, the stronger the connective piece is likely to be in terms of its effectiveness in making winning moves. FIG. 13 illustrates situations in which some connective pieces are located at corner or end positions 1, 2, 3, 4 and hence are ineffective; whereas some other connective pieces at positions 5, 6, 7, 8, 9 have one, two, three and four potential straight chains around them, respectively, and hence they may be effective to different degrees.

It should be realized that a connective piece does not always assure its deploying player a winning position even if it has one uncovered square on each side of it. FIGS. 24A through 24C illustrates such cases, in which the associated move trees show some of the opponent's moves that give the deploying player no chance of winning. Nevertheless, it is particularly worth noting that an effectively located connective piece may greatly enhance the deploying player's winning position in each playing area by converting it into his guaranteed winning position (GWP) independent of which player goes first. FIGS. 25A through 25D illustrate such cases, in which the associated move trees show how the deploying player can always win no matter which player goes first. When two players' exclusive connective pieces coexist in a local playing area, one may give its deploying player a guaranteed winning position whereas the other does not because the former is more effectively located. FIG. 26 illustrates such a case in which the associated move trees explain the situation. Moreover, it should also be pointed out that guaranteed winning positions of different configurations may differ in strength depending on whether the deploying player can impose on his opponent either a forced losing or winning position as he desires in his global strategy.

FIGS. 25A through 25C illustrate cases in which even though the deploying player can always win in a local playing area, nevertheless, the position may be a forced winning one, which might not be desirable in the execution of a global strategy. On the other hand, FIG. 25D illustrates the case of a strong guaranteed winning position in which the deploying player may choose either to win or to lose in a local area to the advantage of his global strategy. In other words, for global strategic play a guaranteed winning position can be most effectively used if it is also a voluntary winning position independent of which player goes first.

FIG. 27A illustrates a simple example in which an exclusive superconnective piece is used to greatly enhance the deploying player's winning position, which an ordinary exclusive connective piece, as shown in FIG. 27B, cannot achieve. Therefore, although the new concepts of the guaranteed winning position are introduced to show the power of connective pieces, the previously discussed concepts of the forced losing position, forced winning position and voluntary winning position remain valid and applicable for strategic planning. From the above examples, it should be obviously seen that the effective strategic deployment and tactical use of connective or superconnective pieces may contribute greatly to the winning of a game. Nevertheless, it should also be remembered that the most effective deployment or use of the connective pieces is highly dependent on the particular move patterns chosen by the players for each game.

Referring now to FIGS. 29 and 30, strategy employable in the preferred game of the present invention based on symmetry or pairing shall be discussed, since, as discussed above, in the initial battle field configuration of the game, or ultimate defined playing area, the property of geometrical symmetry may be used to plan for strategic deployment or partitioning moves. As more separate zones develop during the play of the game, patterns of symmetry may emerge and may be taken advantage of by the players to make winning moves. In the discussion below, symmetry shall be discussed within a single isolated zone where no squares are disconnected as well as between two isolated zones across which no chain connection can be made. With respect to symmetry within an isolated zone, an isolated zone may be easily recognized as a winning or losing positon if all its member squares exhibit symmetry with respect to an imaginary central point. For this situation, symmetry is defined as meaning that within the zone for any square there exists another square colinear with, and equidistant from, but in opposite direction to the imaginary central point. Any isolated configuration which possesses such symmetry and has a blocked or occupied area of either a single piece or multiple pieces covering the imaginary central point is a forced losing position by itself. The reason behind this is that in this case the second player, that is the opponent of the player who goes first, can always assure a win by simply playing with a symmetry or pairing strategy; namely, always placing his pieces at the exact symmetrical position to his opponent's placed pieces, with respect to the imaginary central point, during each move thus insuring the second player to be the one to win in this zone. FIGS. 28A through 28C are illustrative examples of symmetry within a zone of connected squares with the numbers in the squares without the prime (') corresponding to the moves of the first player and the numbers in the squares with the prime (') corresponding to the corresponding moves of the second player. It should be noted that forced losing positions of this type can be quite large and complex and yet easily recognizable. It should also be noted that an isolated zone of such symmetry initially without a central blocked or occupied area can readily be converted into a forced losing position by a player's move at that central area with the central blocked or occupied area being essential to the second player's strategy of pairing moves since otherwise the first player might make a chain to cut through the central point to switch the situation to his advantage or to destroy the symmetry.

FIGS. 29A through 29K illustrate examples of symmetry between disconnected zones with the aforementioned symmetry or pairing strategy being applicable in principle not only to a single isolated zone possessing a point centered symmetry but being equally applicable to two totally disconnected zones with equivalent or isomorphic configurations. Two configurations may be defined as equivalent if, and only if, they have equal numbers of squares with the same connective relationship among all squares regardless of their relative orientations on the board, such as shown in FIGS. 29A through 29K. Because of such a relationship, in response to any move the first player makes in one zone, the player can always make a countermove at an exact equivalent position in the other zone. The second player can be assured a win by consistently doing so between the two zones. As compared to the pairing strategy discussed above for a single isolated zone, this strategy can be more flexibly applied since it can be carried out without regard to either relative orientations of the two configurations or the geometrical distance between them, with such a strategy being applicable in pre-play piece deployment, at an early stage of zone partitioning as well as in normal move-to-move play. It should be noted that FIGS. 29I and 29J are equivalent whereas FIG. 29K is not equivalent to either FIGS. 29I or 29J since squares A and E in FIG. 29K are not directly connected whereas squares 1 and 5 in FIGS. 29I and 29J are.

Lastly, referring to FIG. 30, examples of opening moves using the aforementioned symmetry strategy are illustrated with the moves being sequentially denoted by consecutive integers and with repetitive integers being used to indicate a chain of squares occupied by a move. In addition, a chain of encircled repetitive integers is preferably used to indicate a wrong move which leads to the opponent's implementation of a symmetry strategy. Thus, when an initial field or ultimate defined playing area is constructed from overlays 32 and/or blocking pieces 42, the players should be extremely careful to avoid creating symmetry which could markedly affect the outcome of the game. An initial field which possesses the aforementioned symmetry within an isolated zone, for example, is obviously unfair to the player who goes first. Similarly, an initial field which can be converted to such symmetry in one move is obviously unfair to the player who goes second. Thus, if a player can point out either of the two conditions exist before a game starts, preferably the initial field should be reconstructed or the game will not be challenging. A totally unblocked initial field with odd numbered rows or columns is unfair to the player who goes second since a single move covering the central square or squares can also create the type of symmetry discussed above. Any totally unblocked initial field with even numbered rows or columns, however, such as an 8-by-8 field recommended for beginner's play will avoid such symmetry and should be satisfactory. When the game is played in a totally unblocked square field with even numbered rows and columns, the players may make strategic opening moves by using symmetries with each player trying to build up a symmetry to his advantage while avoiding being forced into a symmetry to his disadvantage. Particular attention should be paid to any move involving the central square or squares since the occupation of this area could be crucial in creating a winning or losing position as discussed above. As stated above, typical examples of opening strategies are illustrated in FIGS. 30A through 30F, by way of example. It should, of course, be noted that the players may develop a great variety of other opening strategies based on the use of such symmetries or pseudosymmetries.

Thus, in accordance with the present invention, the mathematical based board game apparatus of the present invention provides many parameters which may be varied to make the game flexible to meet different players' interests and requirements and provide different levels of sophistication. Based on these variables, the players may readily devise versions of their own choosing to avoid monotony and change the degree of complexity, thereby adjusting the average playing time per game. For example, beginners may start out by playing straight chain moves on an 8-by-8 board with overlays, blocking or connective pieces, medium level players could play on an 8-by-8 or 12-by-12 board with overlays and/or blocking pieces but without connective pieces and advanced players could use a 12-by-12 or 16-by-16 board with complex overlays as well both blocking and connective pieces deployed at the beginning of each game. Experienced players of high skill levels may consider defining more complex move patterns if desired. Moreover, as previously mentioned, the grid units and/or game board may be any desired configuration such as the triangular structure of FIG. 19 or the hexagonal structure of FIG. 20. Accordingly, a flexible and challenging mathematical based board game is provided in accordance with the present invention.

What is claimed is:

1. In a mathematical based board game apparatus for at least two players having a matrix grid game board containing a playing area defined by a plurality of grid units each capable of containing a game playing piece therein for covering said grid unit in which logical deployment of a plurality of said game playing pieces by said players during alternating designated turns to completely cover all of said grid units defining said playing area determines the winner of the game; the improvement comprising a plurality of different configuration overlays for said game board for varying the size and configuration of the playing area from game to game, each of said overlays exposing a different size and configuration playing area when overlaid on said underlying matrix grid game board for initially varying the complexity of each game to be played in accordance with the resultant exposed playing area;

a plurality of blocking pieces deployable by each of said players prior to the playing of the game for further defining said resultant exposed game playing area configuration and size, each of said blocking pieces capable of covering a single previously uncovered grid unit on said matrix grid game board resultant exposed playing area for creating strategic deployments of uncovered grid units defining an ultimate game playing area for a single game, said blocking pieces covering a previously exposed uncovered grid unit in said resultant exposed playing area and preventing its use by any of said players during the playing of said single game, each of said players having a predetermined quantity of deployable blocking pieces;

a first plurality of exclusive connective game playing pieces for a first player, said first player exclusive connective game playing pieces only being deployable in the uncovered grid units in said defined ultimate game playing area for said single game by said first player prior to the playing of said single game for establishing exclusive link nodes for said first player usable during the playing of said single game for enabling the formation during said first player's turn of a move pattern by said first player including said grid unit covered by one of said first player exclusive connective pieces while preventing said second player from using said first player exclusive connective piece covered grid unit as a link node, said first player having a predetermined quantity of deployable exclusive connective pieces;

a second plurality of exclusive connective game playing pieces for a second player, said second player exclusive connective game playing pieces only being deployable in the uncovered grid units in said defined ultimate game playing area for said single game by said second player during alternating turns with said first player prior to the playing of said single game for establishing exclusive link nodes for said second player usable during the playing of said single game for enabling the formation during said second player's turn of a move pattern by said second player including said grid unit covered by one of said second player exclusive connective pieces while preventing said first player from using said second player exclusive connective piece covered grid unit as a link node, said second player having a predetermined quantity of deployable exclusive connective pieces;

a first plurality of regular game playing pieces for said first player, said first player regular game playing pieces only being deployable by said first player in the uncovered grid units in said ultimate defined playing area for said single game on each of said first player's designated turns during the playing of said single game for either covering a single uncovered grid unit in said ultimate game playing area during one of said turns or for forming any one of a plurality of different move patterns comprising at least an adjacent portion of said first plurality of regular game playing pieces for covering an equal plurality of adjacent uncovered grid units in said ultimate game playing area during one of said turns dependent on the portion of said uncovered ultimate game playing area said first player intends to cover on a given one of said first player's designated turns, at least one of said move patterns formable by said first player capable of comprising at least one of said first player exclusive link nodes; and a second plurality of regular game playing pieces for said second player, said second player regular game playing pieces only being deployable by said second player in the uncovered grid units in said ultimate defined playing area for said single game on each of said second player's designated turns during the playing of said single for either covering a single uncovered grid unit in said ultimate game playing area during one of said turns or for forming any one of a plurality of different move patters comprising at least an adjacent portion of said second plurality of regular game playing pieces for covering an equal plurality of adjacent uncovered grid units in said ultimate game playing area during one of said turns dependent on the portion of said uncovered ultimate game playing area said second player intends to cover on a given one of said second player's designated turns, at least one of said move patterns formable by said second player capable of comprising at least one of said second player exclusive link nodes, whereby each player may initially deploy blocking pieces to define said ultimate game playing area as well as deploy connective pieces dependent on mathematical based strategy and thereafter deploy regular game playing pieces until said ultimate game playing area grid units are completely covered whereupon the winner is determined.

2. A mathematical based board game apparatus in accordance with claim 1 further comprising a second plurality of connective game playing pieces common to said players, said same second plurality of connective game playing pieces being neutral connective game playing pieces only being deployable in the uncovered grid units in said defined ultimate game playing area for said single game by each of said players prior to the playing of said single game for establishing neutral link nodes for said players usable by each of said players during the playing of said single game for enabling the formation during any player's turn of a move pattern by said player including said grid unit covered by one of said neutral connective pieces, at least one of said move patterns formable by each of said players capable of comprising at least one of said neutral link nodes.

3. A mathematical based board game apparatus in accordance with claim 2 wherein said neutral connective pieces are deployable prior to the playing of said single game in place of said first and second player exclusive connective pieces on a common uncovered grid unit in said defined ultimate playing area in which said first and second players both deploy an exclusive connective piece prior to the playing of said single game.

4. A mathematical based board game apparatus in accordance with claim 2 wherein said blocking pieces, exclusive connective pieces and neutral connective pieces deployed prior to the playing of said single game provide a logic set of chain link connective pieces for use during the playing of said single game, with each of said deployed neutral connective pieces corresponding to the logic relationship $A+B$ corresponding to A or B, each of said deployed blocking pieces corresponding to the logic relationship $\overline{A+B}=\bar{A}.\bar{B}$ corresponding to not A and not B and each of said deployed exclusive connective pieces corresponds to the logic relationship $A.\bar{B}$ corresponding to A and not B for the first player deployed exclusive connective pieces and $B.\bar{A}$ corresponding to B and not A for the second player deployed exclusive connective pieces where logic symbol A respresents said first player and logic symbol B represents said second player.

5. A mathematical based board game apparatus in accordance with claim 1 wherein said first and second player predetermined quantities of exclusive connective pieces for said single game are different, said difference being dependent on a predetermined handicap relationship between said first and second players.

6. A mathematical based board game apparatus in accordance with claim 1 wherein said underlying matrix grid game board comprises a rectangular matrix grid of squared grid units.

7. A mathematical based board game apparatus in accordance with claim 1 wherein said first player regular game playing pieces are distinguishable from said second player regular game playing pieces.

8. A mathematical based board game apparatus in accordance with claim 1 wherein said first and second player exclusive connective game playing pieces at least comprise exclusive superconnective game playing pieces, each only being deployable in said defined ultimate game playing area for said single game for establishing exclusive extended link nodes for said player deploying said exclusive superconnective game playing piece for enabling the formation during said one deploying player's turn of a linked chain bridging a predetermined quantity of the other player's deployed regular game playing pieces which are adjacent to said deployed exclusive superconnective game playing piece deployed by said one deploying player, whereby a continuous chain move pattern may be formed during the playing of said single game comprising said deployed exclusive superconnective game playing pieces and at least one of said other player's regular game playing pieces interposed adjacently between said one player deployed exclusive superconnective game playing piece and at least one regular game playing piece of said one deploying player during said one deploying player's turn.

9. A mathematical based game board apparatus in accordance with claim 1 wherein said first and second player formable move patterns comprise continuous linked chains.

10. In a mathematical based board game apparatus for at least two players having a matrix grid game board containing a game playing area ultimately defined by a plurality of grid units each capable of containing a game playing piece therein for covering said grid unit in which logical deployment of a plurality of said game playing pieces by said players during alternating designated turns to completely uncover all of said grid units defining said ultimate game playing area determines the winner of the game; the improvement comprising a plurality of blocking pieces;

a first plurality of exclusive connective game playing pieces for a first player, said first player exclusive connective game playing pieces only being deployable in the uncovered grid units in said defined ultimate game playing area for said single game by said first player during alternating turns with said second player for establishing exclusive link nodes for said first player usable during the playing of said single game for enabling the removal during said first player's turn of a move pattern by said first player including said grid unit covered by one of said first player exclusive connective pieces while preventing said second player from using said first player exclusive connective piece covered grid unit as a link node, said first player having a predetermined quantity of deployable exclusive connective pieces;

a second plurality of exclusive connective game playing pieces for a second player, said second player exclusive connective game playing pieces only being deployable in the uncovered grid units in said defined ultimate game playing area for said single game by said second player during alternating turns with said first player for establishing exclusive link nodes for said second player usable during the playing of said single game for enabling the removal during said second player's turn of a move pattern by said second player including said grid unit covered by one of said second player exclusive connective pieces while preventing said first player from using said second player exclusive connective piece covered grid unit as a link node, said second player having a predetermined quantity of deployable exclusive connective pieces;

a first plurality of regular game playing pieces for said first player deployable in said ultimate defined game playing area prior to the playing of said single game, said deployed first player regular game playing pieces only being removable by said first player from the grid units covered thereby in said ultimate defined playing area for said single game on each of said first player's designated turns during the playing of said single game for either uncovering a single covered grid unit in said ultimate game playing area during one of said turns for removing any one of a plurality of different move patterns comprising at least an adjacent portion of said deployed first plurality of regular game playing pieces for uncovering an equal plurality of adjacent covered grid units in said ultimate game playing area during one of said turns dependent on the portion of said covered ultimate game playing area said first player intends to uncover on a given one of said first player's designated turns, at least one of said move patterns removable by said first player comprising at least one of said first player exclusive link nodes; and a second plurality of regular game playing pieces for said second player deployable in said ultimate defined game playing area prior to the playing of said single game, said deployed second player regular game playing pieces only being removable by said second player from the covered grid units in said ultimate defined playing area for said single game on each of said second player's designated turns during the playing of said single game for either uncovering a single covered grid unit in said ultimate game playing area during one of said turns or for removing any one of a plurality of different move patterns comprising at least an adjacent portion of said deployed second plurality of regular game playing pieces for uncovering an equal plurality of adjacent covered grid units in said ultimate game playing area during one of said turns dependent on the portion of said covered ultimate game playing area said second player intends to uncover on a given one of said second player's designated turns, at least one of said move patterns removable by said second player comprising at least one of said second player exclusive link nodes, said deployed first and second player regular game playing pieces prior to the playing of said single game completely covering said ultimate defined game playing area, whereby each player may initially deploy blocking pieces to define said ultimate game playing area as well as deploy connective pieces dependent on mathematical based strategy, thereafter deploying regular game playing pieces until said ultimate game playing area grid units are completely covered, and thereafter remove at least said regular game playing pieces and connective pieces during each of said turns during the playing of said single game until all of said grid units defining said ultimate game playing area covered by said regular and connective pieces are uncovered whereupon the winner is determined.

11. A mathematical based game board apparatus in accordance with claim 10 wherein said first and second player removable move patterns comprise continuous linked chains.

* * * * *